US007287923B1

(12) United States Patent
Chen

(10) Patent No.: US 7,287,923 B1
(45) Date of Patent: Oct. 30, 2007

(54) MULTIFUNCTIONAL COSMETIC CONTAINER

(76) Inventor: Sin-Hsiung Chen, No. 140, Cheng-Pei 1 Rd., Yung Kang City, Tainan Hsien (TW)

( * ) Notice: Subject to any disclaimer, the term of this patent is extended or adjusted under 35 U.S.C. 154(b) by 0 days.

(21) Appl. No.: 11/517,406

(22) Filed: Sep. 8, 2006

(51) Int. Cl.
*B43K 27/02* (2006.01)
*B05C 1/00* (2006.01)
*B65D 69/00* (2006.01)
*A45D 40/24* (2006.01)

(52) U.S. Cl. ..... 401/18; 401/17; 401/19; 206/581; 132/317

(58) Field of Classification Search ..... 401/16, 401/17, 18, 19, 21, 23, 24, 25, 34, 35; 206/385, 206/581, 823; 220/4.24, 4.25, 4.27, 23.83; 132/317, 73.5
See application file for complete search history.

(56) References Cited

U.S. PATENT DOCUMENTS

D300,269 S * 3/1989 Cassai et al. ..... D28/77
4,886,080 A 12/1989 Cole
5,135,823 A * 8/1992 Eales ..... 429/156
5,226,541 A 7/1993 Huang
5,897,262 A * 4/1999 Bratby-Carey ..... 401/18
6,035,865 A * 3/2000 Krieger ..... 132/294
6,149,330 A * 11/2000 Chuang ..... 401/57
6,612,764 B2 * 9/2003 Dumler et al. ..... 401/18
6,682,242 B1 1/2004 Montoli
6,726,016 B2 4/2004 Chen
6,877,922 B2 * 4/2005 Ahmed ..... 401/35
7,033,101 B2 * 4/2006 Han ..... 401/129
2005/0087207 A1 4/2005 Rousselet
2006/0130868 A1 6/2006 Noel

FOREIGN PATENT DOCUMENTS

EP 1661484 5/2006

* cited by examiner

*Primary Examiner*—David J. Walczak
(74) *Attorney, Agent, or Firm*—Rosenberg, Klein & Lee

(57) ABSTRACT

A multifunctional cosmetic container has a first casing, at least one second casing and multiple cosmetic units. The first casing a chamber defined in the first casing. The at least one second casing is mounted detachably to the first casing each of the at least one second casing has a chamber defined in the second casing. The cosmetic units are mounted respectively in the chambers in the first and second casings. The multifunctional cosmetic container compactly combines the different cosmetic units in one pack so carrying the cosmetic units is easy and convenient.

8 Claims, 13 Drawing Sheets

MULTIFUNCTIONAL COSMETIC CONTAINER

BACKGROUND OF THE INVENTION

1. Field of the Invention

The present invention relates to a cosmetic container, and particularly relates to a multifunctional cosmetic container that may be carried and used easily and conveniently.

2. Description of the Related Art

Early multifunctional cosmetic assemblies as disclosed in U.S. Pat. No. D311787 have a bottle, which is divided into two chambers. The bottle has two nozzles respectively protruding from the two chambers. Two caps are respectively covers the two nozzles. The two chambers are respectively filled with two kinds of cosmetics. However, the two nozzles both protrude, so taking bottles are inconvenient.

Another U.S. Pat. No. 6,726,016 discloses a container assembly two oppositely arranged container bodies. The two container bodies can be pushed to slide in reverse directions to expose their nozzle holes and to facilitate the spray of the perfume in the container bodies. In addition, the container bodies are designed to respectively accommodate different perfume bottles therein. With the container assembly, carrying and using the perfume bottles become convenient. Furthermore, users can replace the perfume bottles in the container assembly as their wish.

Nevertheless, the container assembly with the container bodies, caps, and junction plates is complicated and has a high cost. When the perfume bottles are replaced, the cap must be removed, and it is also inconvenient.

Therefore, the invention provides a multifunctional cosmetic container to mitigate or obviate the aforementioned problems.

SUMMARY OF THE INVENTION

The main objective of the present invention is to provide a multifunctional cosmetic container that may be carried and used easily and conveniently.

A multifunctional cosmetic container has a first casing, at least one second casing and multiple cosmetic units. The first casing a chamber defined in the first casing. The at least one second casing is mounted detachably to the first casing each of the at least one second casing has a chamber defined in the second casing. The cosmetic units are mounted respectively in the chambers in the first and second casings.

Other objectives, advantages and novel features of the invention will become more apparent from the following detailed description when taken in conjunction with the accompanying drawings.

DETAILED DESCRIPTION OF THE PREFERRED EMBODIMENT

Figure 1:
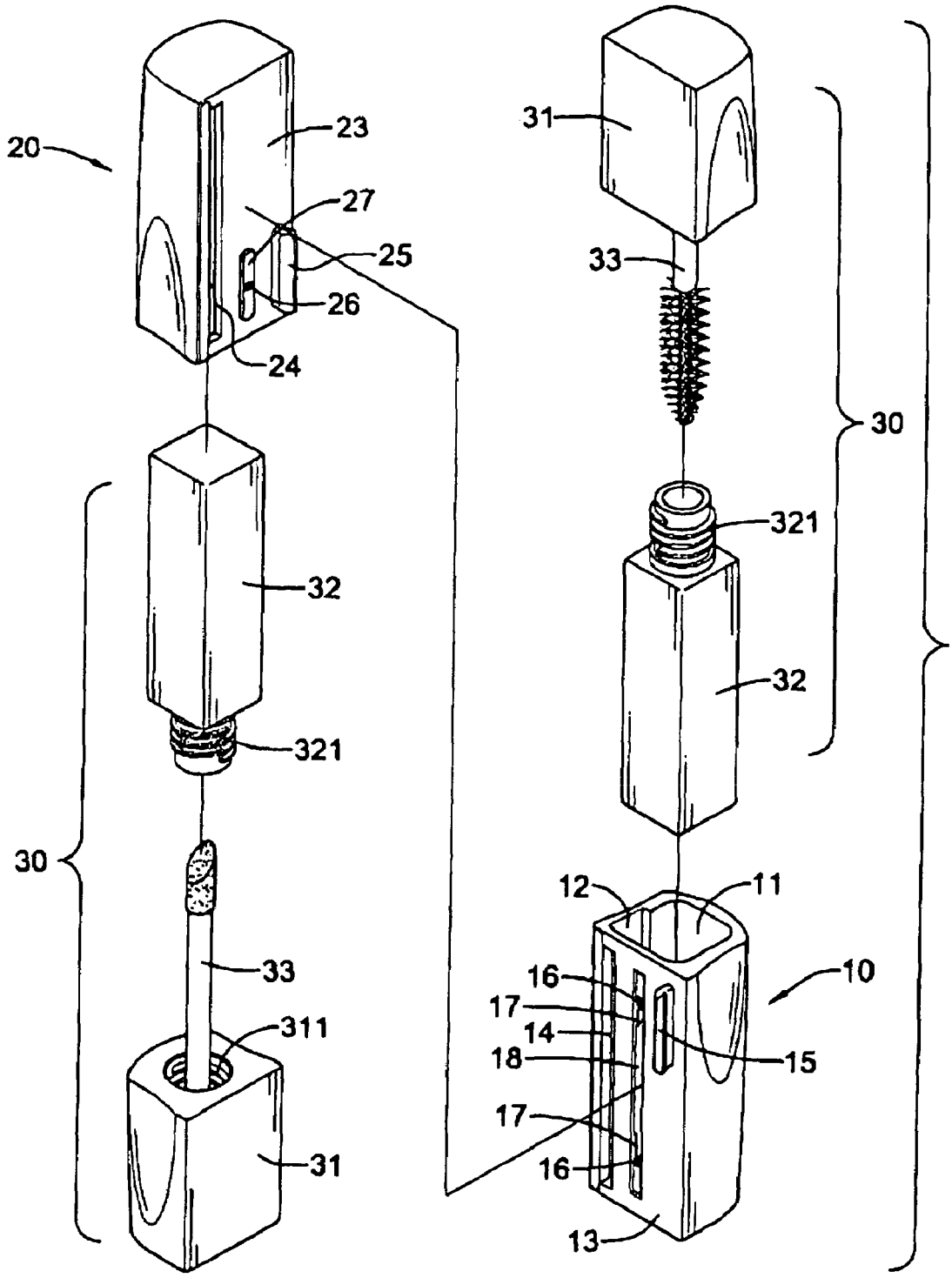
FIG. 1 is an exploded perspective view of a first embodiment of a multifunctional cosmetic container in accordance with the present invention.
Figure 2:
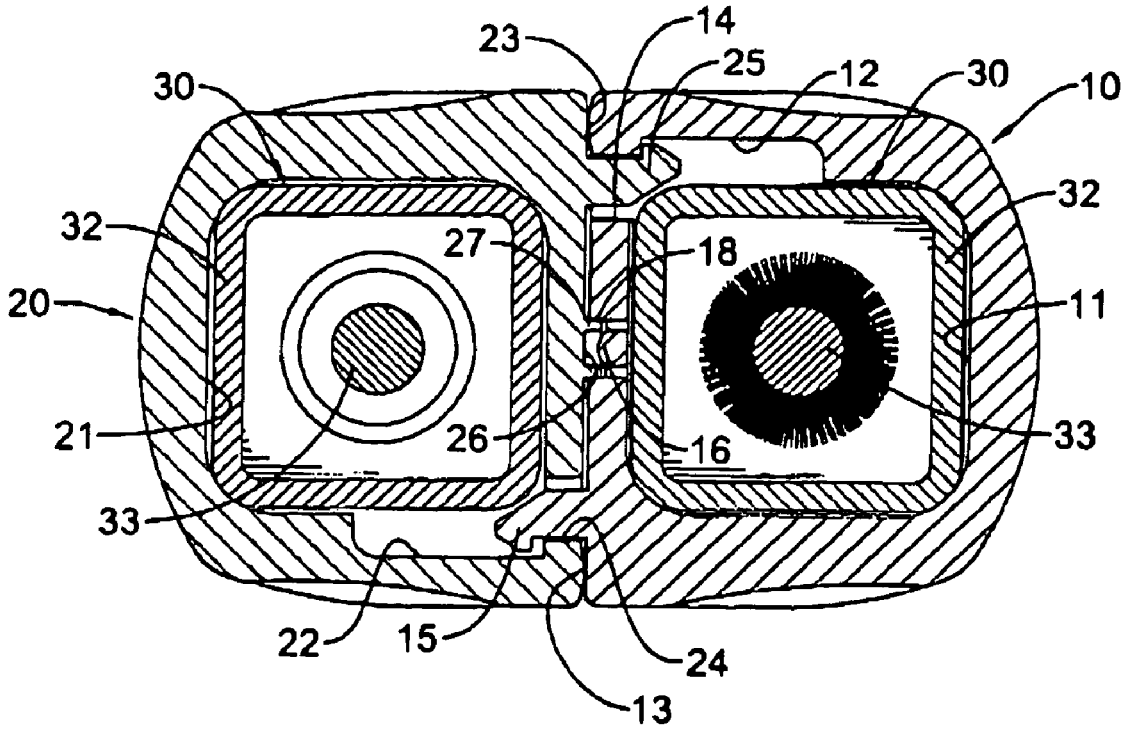
FIG. 2 is a cross sectional top view of the multifunctional cosmetic container in FIG. 1.
Figure 3:
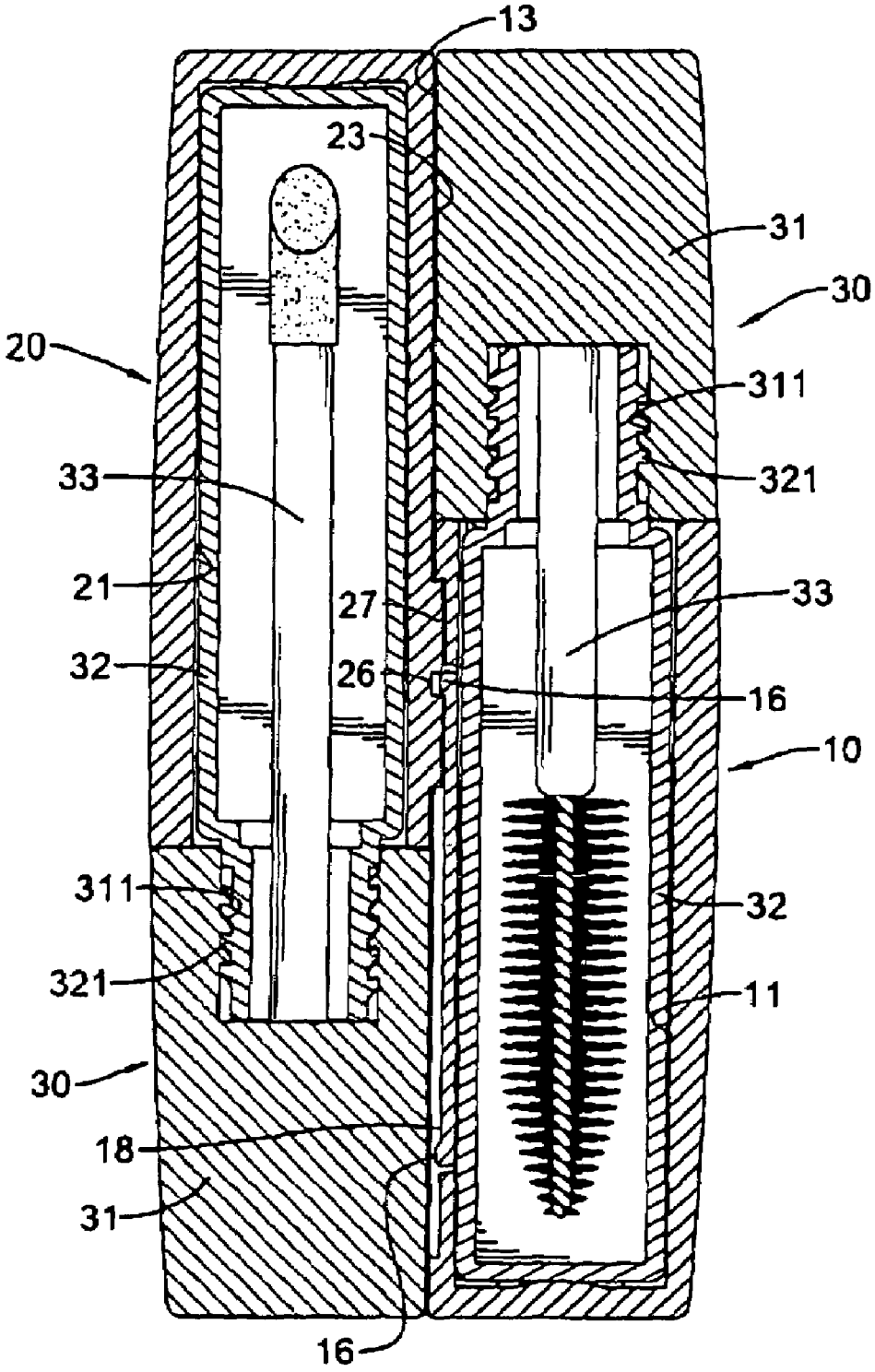
FIG. 3 is a front view in partial section of the multifunctional cosmetic container in FIG. 1.
Figure 4:
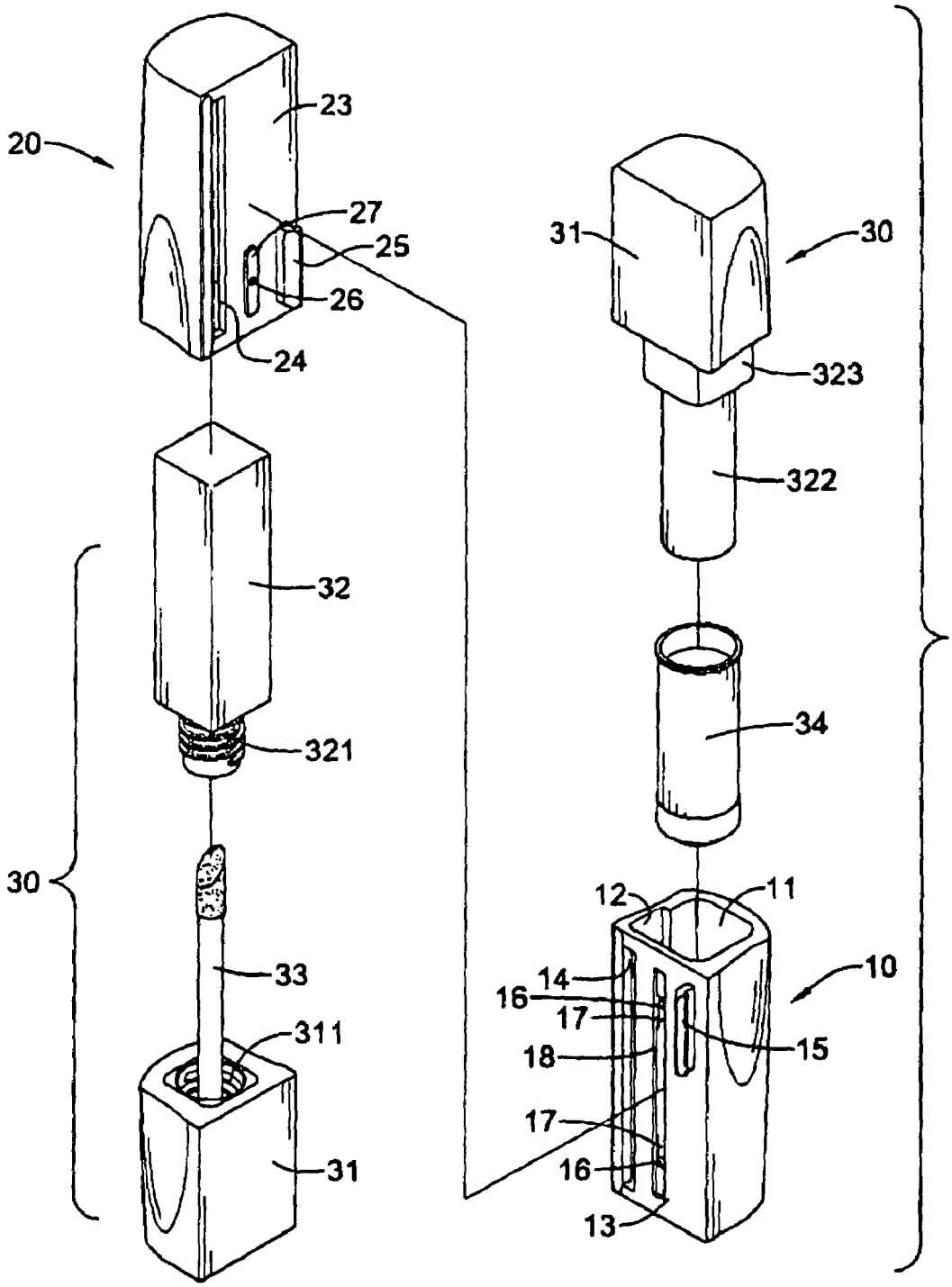
FIG. 4 is an exploded perspective view of the multifunctional cosmetic container in FIG. 1 with a lipstick tube mounted in the first casing.
Figure 5:
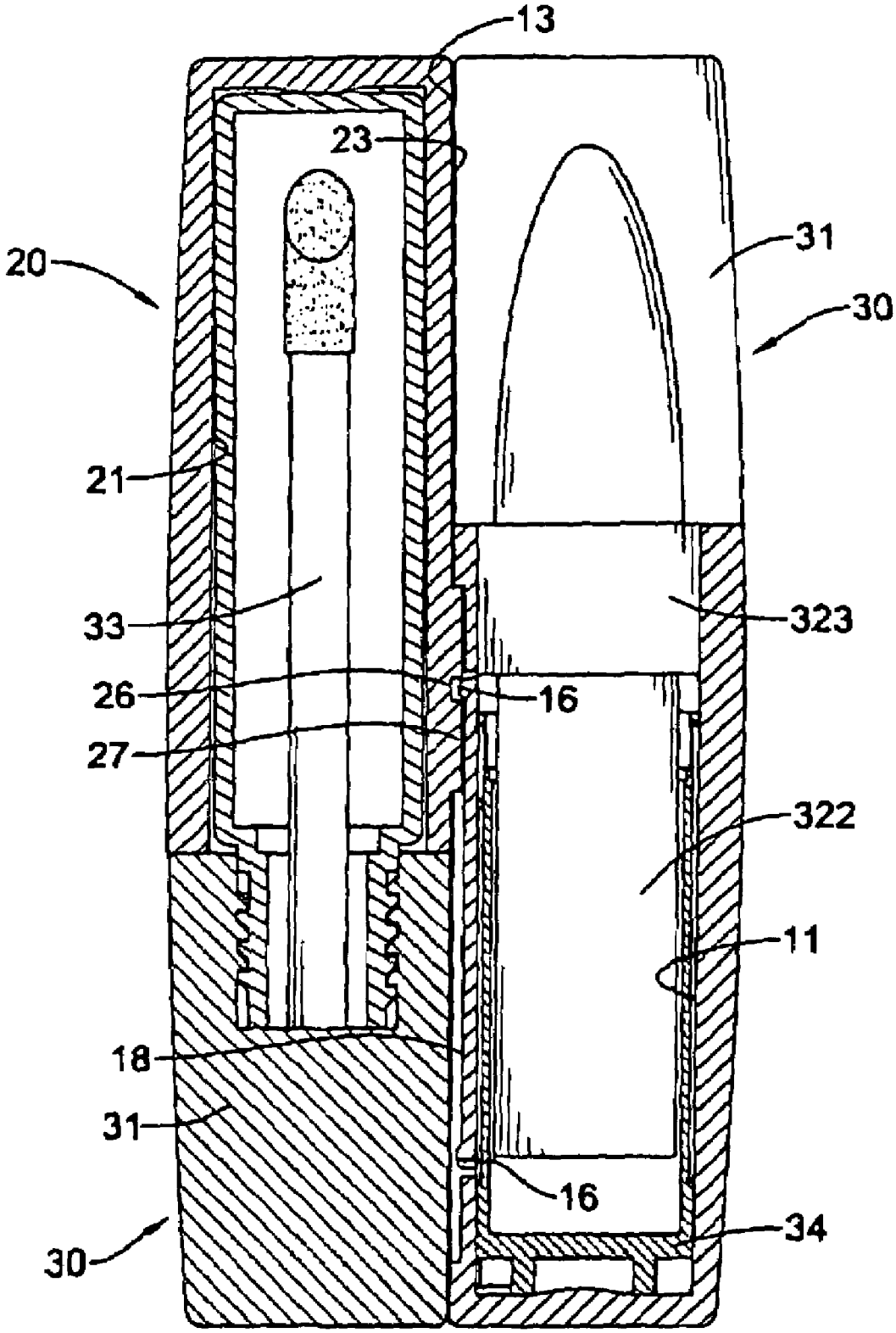
FIG. 5 is a front view in partial section of the multifunctional cosmetic container in FIG. 4.
Figure 8:
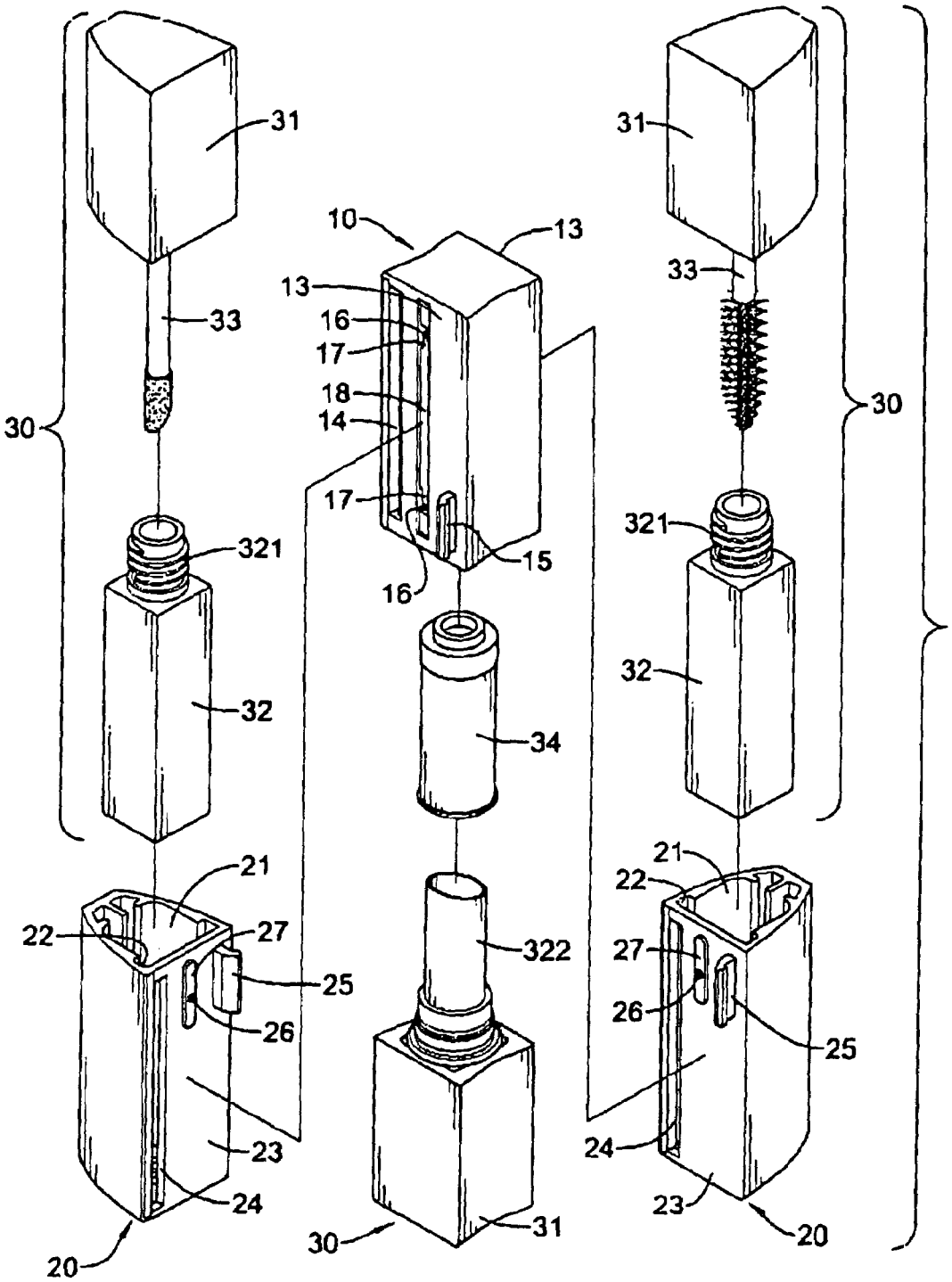
FIG. 8 is an exploded perspective view of a second embodiment of the multifunctional cosmetic container in accordance with the present invention.
Figure 9:
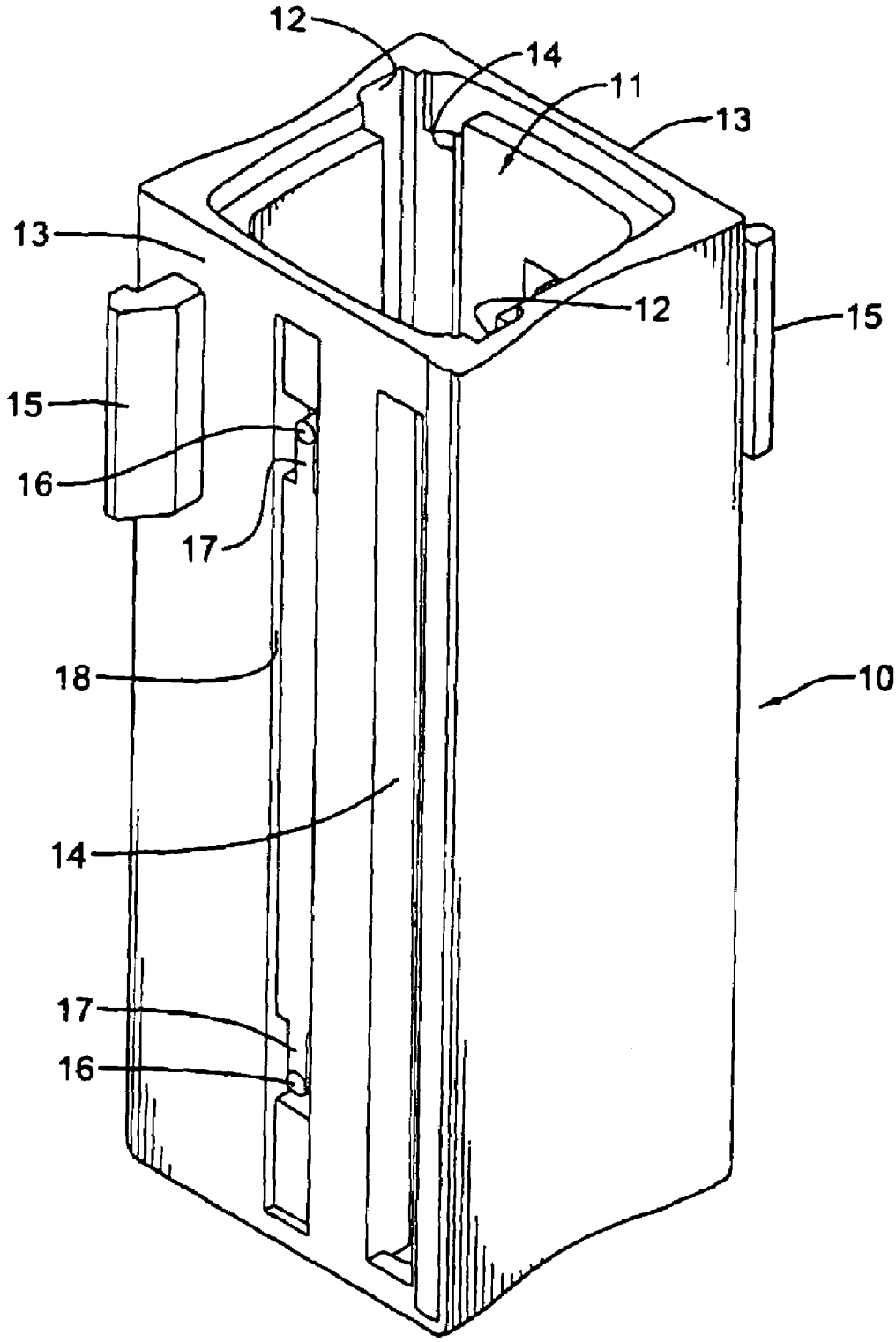
FIG. 9 is a perspective view of the first casing of the multifunctional cosmetic container with the chamber of the first casing facing upward.
Figure 10:
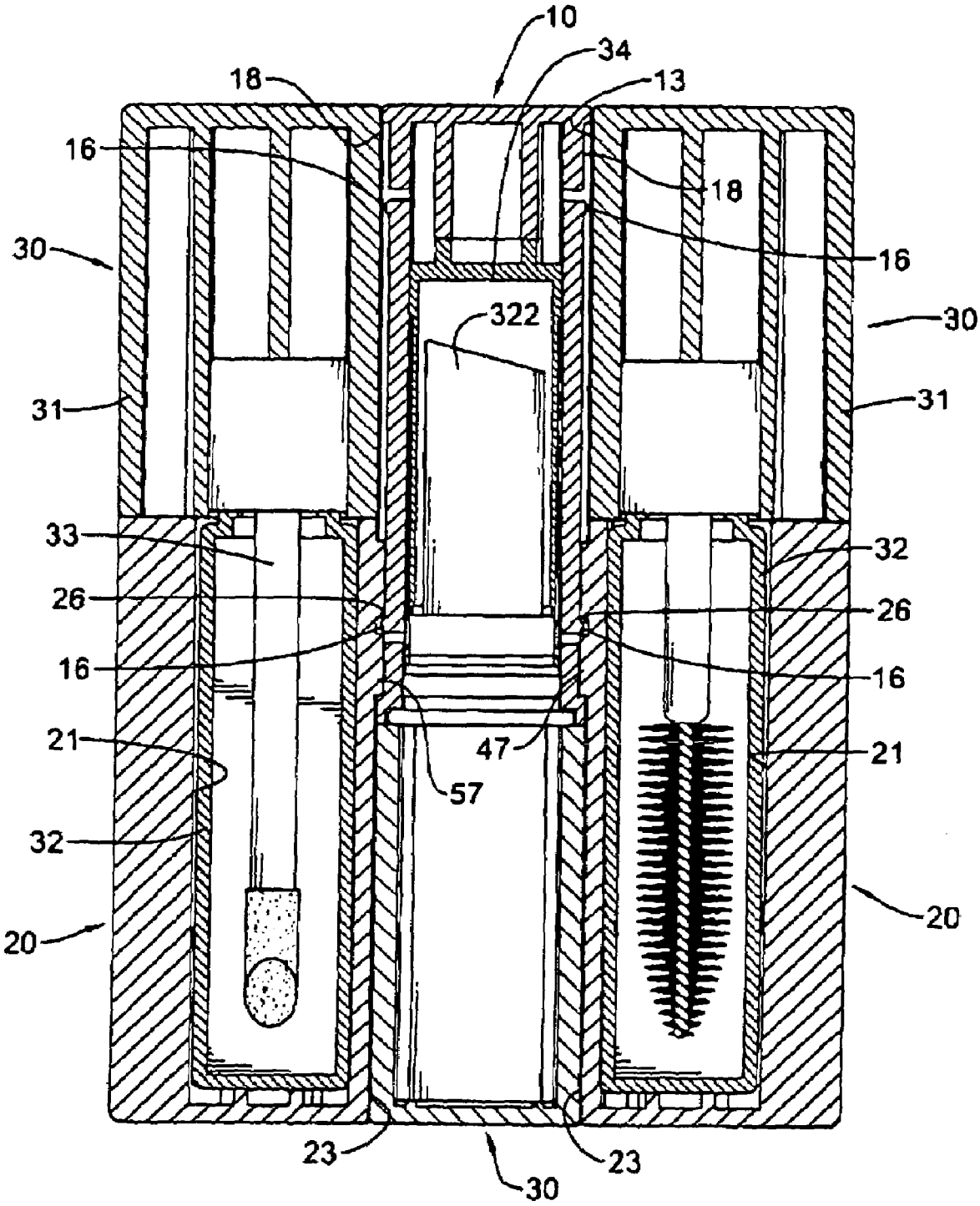
FIG. 10 is a front view in partial section of the multifunctional cosmetic container in FIG. 9.
Figure 11:
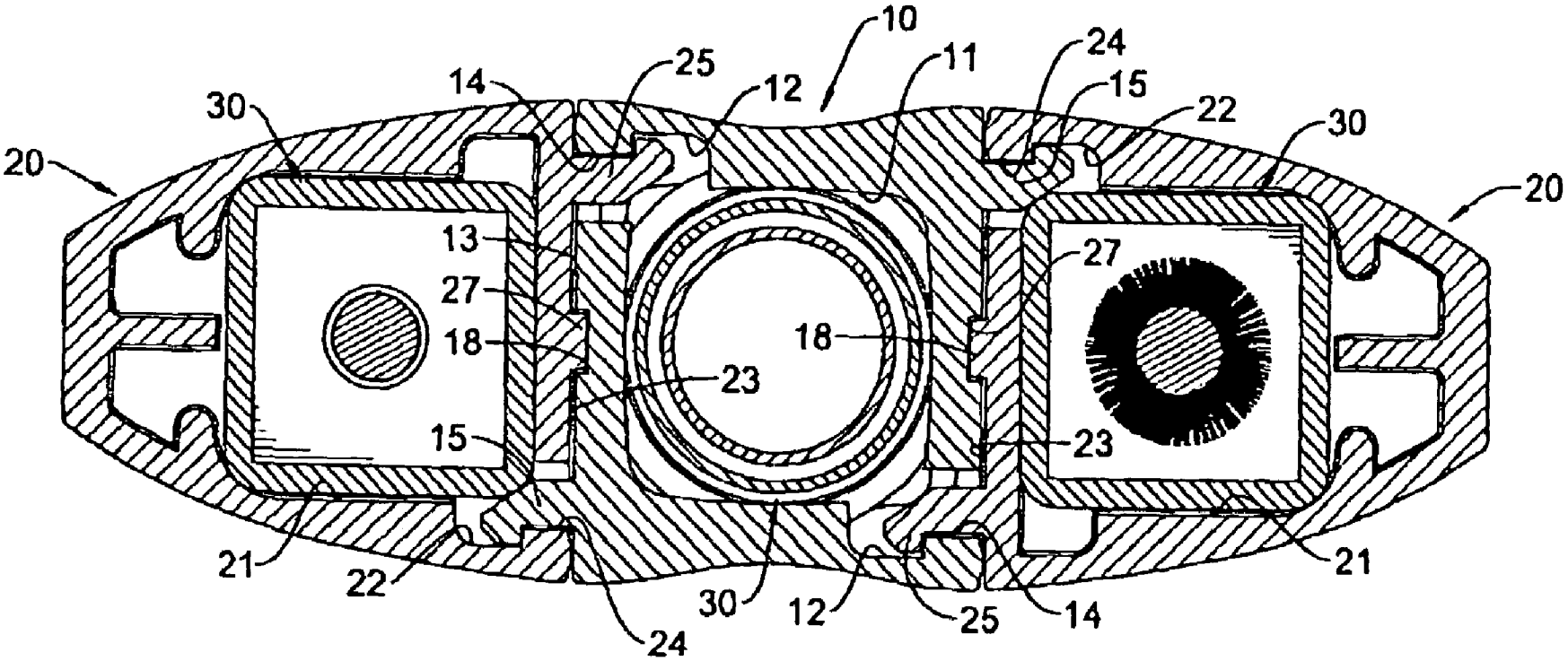
FIG. 11 is a cross sectional top view of the multifunctional cosmetic container in FIG. 10.

With reference to FIGS. 1, 4 and 8, a multifunctional cosmetic container in accordance with the present invention comprises a first casing (10), at least one second casing (20) and multiple cosmetic units (30). With reference to FIGS. 1 and 4, a first embodiment of the multifunctional cosmetic container has one second casing (20) and two cosmetic units (30). With reference to FIG. 8, a second embodiment of the multifunctional cosmetic container has two second casings (20) and three cosmetic units (30).

With reference FIGS. 1, 4, 8 and 9, the first casing (10) has a top, a bottom, two opposite sides, a chamber (11), at least one engaging recess (12) and at least one engaging segment (13).

The chamber (11) is defined in the top or the bottom of first casing (10) and has an inner surface.

The at least one recess (12) is defined in the inner surface of the chamber (11). The first embodiment of the multifunctional cosmetic container has the first casing (10) having a single engaging recess (12). The second embodiment of the multifunctional cosmetic container has the first casing (10) two engaging recesses (12).

The at least one engaging segment (13) correspond respectively to the at least one engaging recess (12) and each of the at least one engaging segment (13) is formed one of the opposite sides. The first embodiment of the multifunctional cosmetic container has a single engaging segment (13) formed on one of the opposite sides of the first casing (10). The second embodiment of the multifunctional cosmetic container has two engaging segments (13) formed respectively on the opposite sides of the first casing (10). Each of the at least one engaging segment (13) has a hook slot (14), a slide hook (15), a slide slot (18), two recoiling tabs (17) and two positioning bosses (16). The hook slot (14) is defined through the engaging segment (13) and communicates with a corresponding one of the at least one engaging recess (12) in the chamber (11). The slide hook (15) is formed on the engaging segment (13). The slide slot (18) is defined in the engaging segment (13) between the hook slot (14) and the slide hook (15) and has an inner surface. The recoiling tabs (17) are resilient, are formed in the inner surface of the slide slot (18) and each recoiling tab (17) has a free distal end. The positioning bosses (16) are formed respectively on the free distal end of the recoiling tabs (17) and face outward from the slide slot (18).

With reference to FIGS. 1, 4 and 8, the at least one second casing (20) is mounted slidably and detachably to the first casing (10) and correspond respectively to the at least one engaging segment (13) on the first casing (10). The first embodiment of the multifunctional cosmetic container has a single second casing (20) corresponding to the single engaging segment (13) on the first casing (10). The second embodiment of the multifunctional cosmetic container has two second casings (20) corresponding to the two engaging segments (13) on the first casing (10).

Each of the at least one second casing (20) has a top, a bottom, an inside, a chamber (21), an engaging recess (12) and an engaging segment (23).

The chamber (21) is defined in the top or bottom of the second casing (20) and has an inner surface.

The engaging recess (12) is defined in the inner surface of the chamber (21) in the second casing (20).

With further reference to FIGS. 2, 3, 10 and 11, the engaging segment (23) is formed on the inside of the second casing (20), engages slidably with a corresponding engaging segment (13) on the first casing (10) and has a hook slot (24), a slide hook (25) and a slide (27). The hook slot (24) is defined through the engaging segment (23) on the second casing (20), communicates with the engaging recess (22) in the second casing (20) and slidably holds the slide hook (15) on the corresponding engaging segment (13) on the first casing (10). The slide hook (25) is formed on the engaging segment (23) on the second casing (20), slidably extends through the hook slot (14) and hooks in a corresponding one of the at least one engaging recess (12) in the first casing (10). The slide (27) is formed on the engaging segment (23) on the second casing (20), is mounted slidably in the slide slot (18) in the corresponding engaging segment (13) on the first casing (10) and has a positioning notch (26). The positioning notch (26) is defined in the slide (27) and selectively engages with one of the positioning bosses (16) on the corresponding engaging segment (13) on the first casing (10). The engagement of the positioning boss (16) and the positioning notch (26) positions the second casing (20) on the first casing (10) without inadvertent sliding.

With reference to FIGS. 1, 4, 5 and 8, the cosmetic units (30) corresponds respectively to the first and the second casings (10, 20) and are detachably mounted respectively in the chambers (11, 21). The cosmetic units (30) are replaceable at will. The first embodiment of the multifunctional cosmetic container has two cosmetic units (30). The second embodiment of the multifunctional cosmetic container has three cosmetic units (30). Each cosmetic unit (30) has a body (32, 322) and a cap (31).

The body (32, 322) is hollow, is mounted detachably in the chamber (11, 21) of the corresponding one of the first and the second casings (10, 20) and may hold cosmetic products such as a lipstick or eyeliner cream.

The cap (31) is mounted detachably on the body (32, 322) adjacent to the corresponding one of the first and the second casings (10, 20) and covers the chamber (11, 21) of the corresponding one of the first and the second casings (10, 20). The cap (31) has a mounting hole defined in the cap (31) and detachably holds the body (32, 322).

With reference FIGS. 1 and 4, the first embodiment of the multifunctional cosmetic container has two bodies (32, 322) and two caps (31). The bodies (32) are bottles. Each bottle has an opening and an outer thread (321) formed on the body (32) around the opening. Each cap (31) has an inner thread (311) formed in the mounting hole and engaging with the outer thread (321) on one of the bottles and a tool (33) mounted in the mounting hole and extending in the bottle. The tool (33) may be a brush. Alternatively, one body (32) is a bottle as described above and the other body (322) is a lipstick tube. The lipstick tube has a lipstick, a knob (323) and an outer sleeve (34). The lipstick is mounted in the lipstick tube. The knob (323) is mounted rotatably on the lipstick tube and rotates to protrude or retract lipstick. The outer sleeve (34) is mounted on the lipstick tube and covers the lipstick. One cap (31) has an inner thread (311) as describe above and the other cap (31) has the mounting hole holding the lipstick tube.

With reference to FIG. 8, the second embodiment of the multifunctional cosmetic container has three bodies (32, 322) and three caps (31). Two of the bodies (32) are bottles as aforementioned and the last body (322) is a lipstick tube with an outer sleeve (34). The lipstick tube has a lipstick, a knob and an outer sleeve (34). The lipstick is mounted in the lipstick tube. The knob is mounted rotatably on the lipstick tube. The outer sleeve (34) is mounted around the lipstick tube. Each of two of the caps (31) has an inner thread (311) as aforementioned and the last cap (31) has the mounting hole holding the lipstick with the outer sleeve (34).

Figure 6:
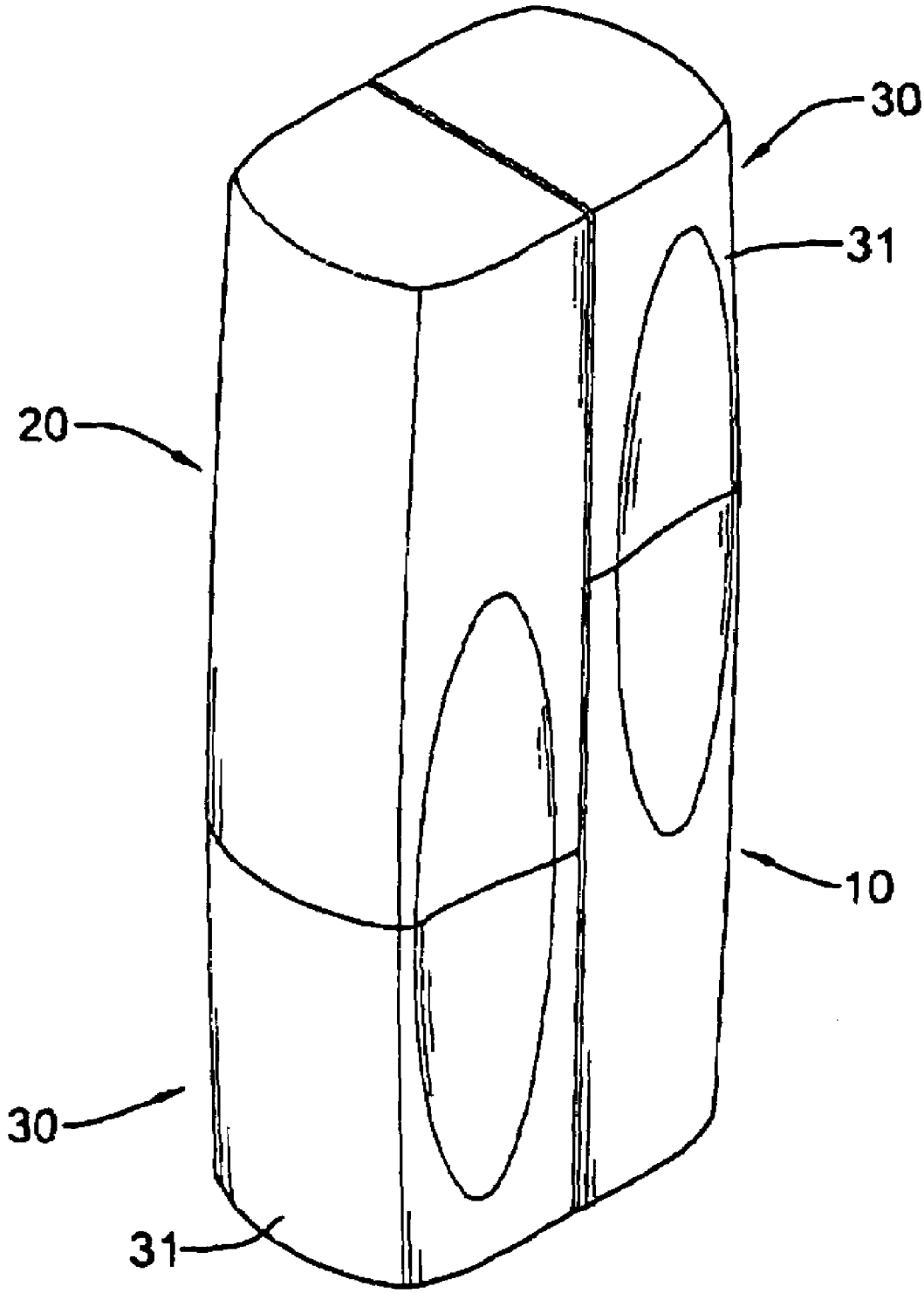
FIG. 6 is a perspective view of the multifunctional cosmetic container in FIGS. 1 and 4.
Figure 12:
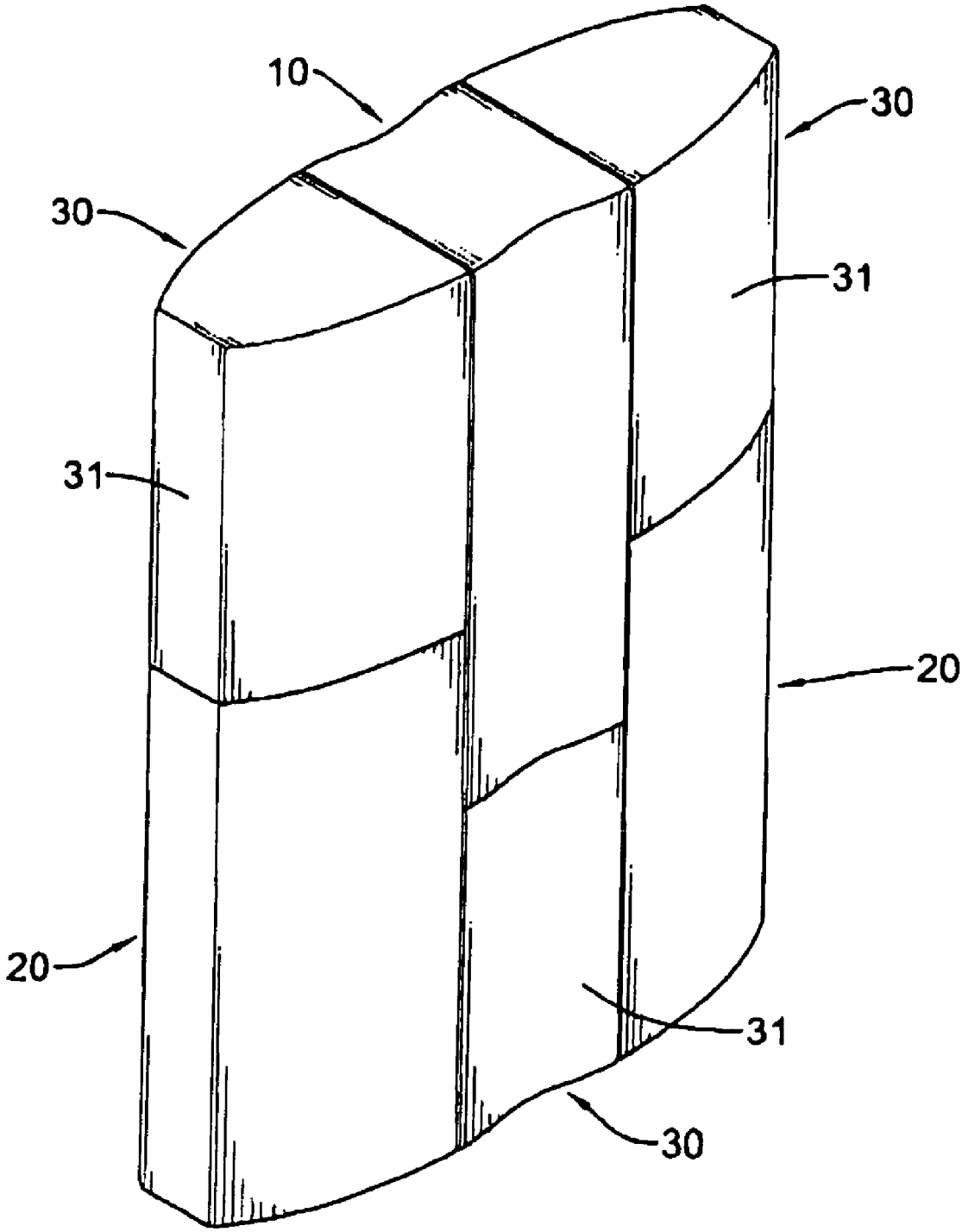
FIG. 12 is a perspective view of the multifunctional cosmetic container in FIG. 8.

With reference to FIGS. 6 and 12, when people carry the multifunctional cosmetic container, the first and second casings (10, 20) are aligned with each other to be compact.

Figure 7:
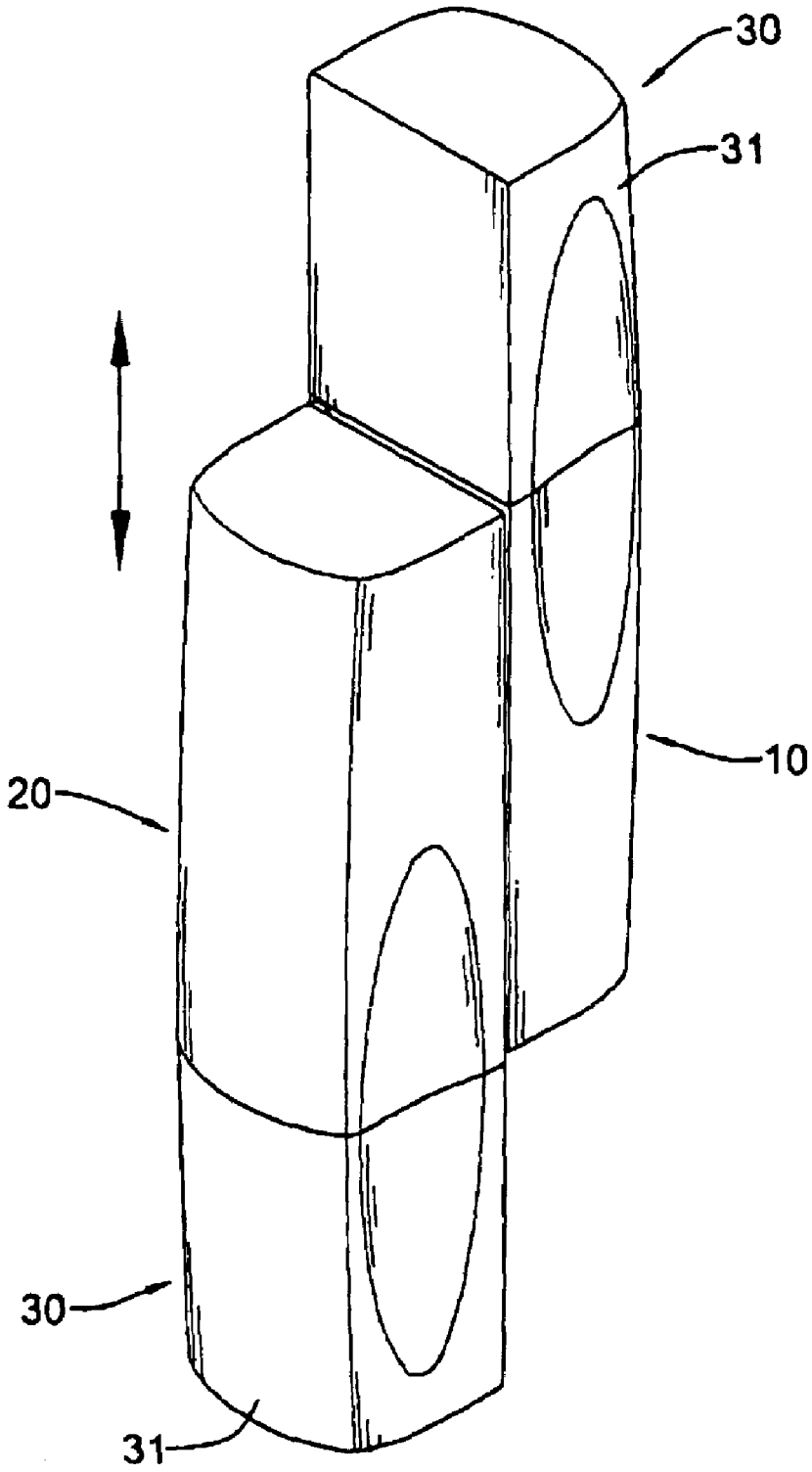
FIG. 7 is an operational perspective view of the multifunctional cosmetic container with the first and second casings sliding respectively in two reverse directions.
Figure 13:
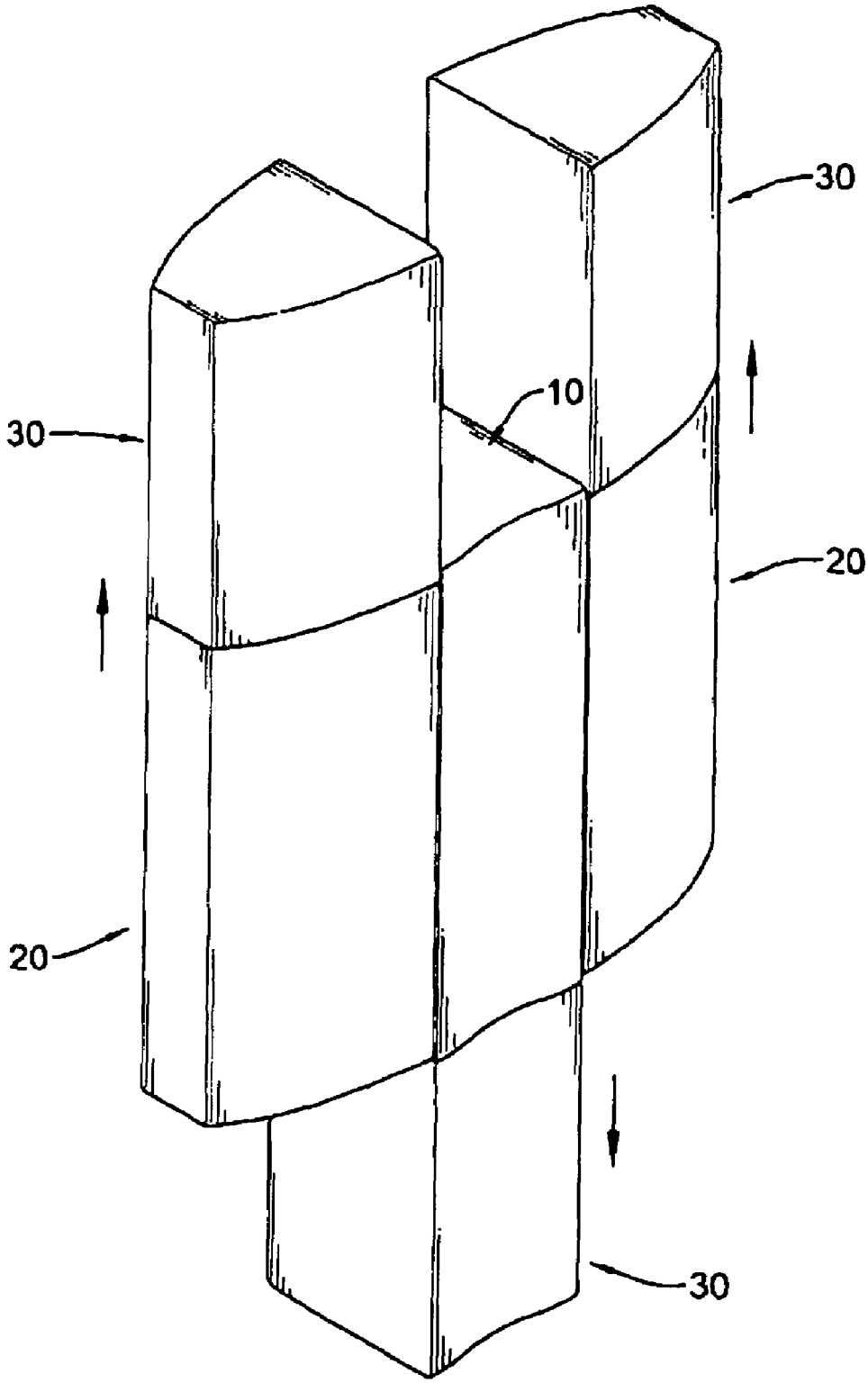
FIG. 13 is an operational perspective view of the multifunctional cosmetic container with the second casings sliding relative to the first casing.

With reference to FIGS. 7 and 13, when people use the multifunctional cosmetic container, the first and second casings (10, 20) slide relative to each other in a stagger arrangement to allow them to quickly pickup the cosmetic units (30).

Because the multifunctional cosmetic container compactly combines the different cosmetic units (30) in one pack, carrying the cosmetic units (30) is easy and convenient.

It is to be understood, however, that even though numerous characteristics and advantages of the present invention have been set forth in the foregoing description, together with details of the structure and function of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. A multifunctional cosmetic container comprising:

a first casing having a top;

a bottom;

two opposite sides;

a chamber defined in the first casing and having an inner surface;

at least one engaging recess defined in the inner surface of the chamber; and at least one engaging segment corresponding respectively to the at least one engaging recess and each of the at least one engaging segment formed one of the opposite sides and each of the at least one engaging segment having a hook slot defined through the engaging segment and communicates with a corresponding one of the at least one engaging recess in the chamber; and a slide hook formed on the engaging segment;

at least one second casing mounted slidably and detachably to the first casing and corresponding respectively to the at least one engaging segment on the first casing and each of the at least one second casing having a top;

a bottom;

an inside;

a chamber defined in the second casing and having an inner surface;

an engaging recess defined in the inner surface of the chamber in the second casing; and an engaging segment formed on the inside of the second casing, engaging slidably with a corresponding engaging segment on the first casing and having a hook slot defined through the engaging segment on the second casing, communicating with the engaging recess in the second casing and slidably holding the slide hook on the corresponding engaging segment on the first casing; and a slide book formed on the engaging segment on the second casing, slidably extending through the hook slot on the corresponding engaging segment on the first casing and hooking in a corresponding one of the at least one engaging recess in the first casing; and multiple cosmetic units corresponding respectively to the first and the second casings and detachably mounted respectively in the chambers and each cosmetic unit having a body being hollow, mounted detachably in the chamber of the corresponding one of the first and the second casings; and a cap mounted detachably on the body adjacent to the corresponding one of the first and the second casings, covering the chamber of the corresponding one of the first and the second casings and having a mounting hole defined in the cap and detachably holding the body.

2. The multifunctional cosmetic container as claimed in claim 1, wherein:

each of the at least one engaging segment on the first casing further has a slide slot defined in the engaging segment between the hook slot and the slide hook and having an inner surface;

two recoiling tabs being resilient, formed in the inner surface of the slide slot and each recoiling tab having a free distal end; and two positioning bosses formed respectively on the free distal end of the recoiling tabs and facing outward from the slide slot; and the engaging segment on each of the at least one second casing further has a slide formed on the engaging segment, mounted slidably in the slide slot in the corresponding engaging segment on the first casing and having a positioning notch defined in the slide and selectively engaging with one of the positioning bosses on the corresponding engaging segment on the first casing.

3. The multifunctional cosmetic container as claimed in claim 2, wherein:

the first casing has a single engaging recess and a single engaging segment formed on one of the opposite sides of the first casing; and the multifunctional cosmetic container has a single second casing corresponding to the single engaging segment on the first casing; and two cosmetic units corresponding to the first casing and the second casing.

4. The multifunctional cosmetic container as claimed in claim 3, wherein the body of each cosmetic unit is a bottle having an opening and an outer thread formed on the body around the opening and each cap has an inner thread formed in the mounting hole and engaging with the outer thread on one of the bottles and a tool mounted in the mounting hole and extending in the bottle.

5. The multifunctional cosmetic container as claimed in claim 3, wherein:

one body is a bottle having an opening and an outer thread formed on the body around the opening and the other body is a lipstick tube having a knob mounted rotatably on the lipstick tube and adapted to rotate to protrude or retract a lipstick and an outer sleeve mounted on the lipstick and adapted to cover the lipstick; and one cap has an inner thread formed in the mounting hole and engaging with the outer thread of the bottle and a tool mounted in the mounting hole and extending in the bottle and the other cap has the mounting hole holding the lipstick tube.

6. The multifunctional cosmetic container as claimed in claim 2, wherein:

the first casing has two engaging recesses and two engaging segments formed respectively on the opposite sides of the first casing; and the multifunctional cosmetic container has two second casings corresponding respectively to the engaging segments on the first casing; and three cosmetic units corresponding to the first casing and the second casings.

7. The multifunctional cosmetic container as claimed in claim 6, wherein the body of each cosmetic unit is a bottle having an opening and an outer thread formed on the body around the opening and each cap has an inner thread formed in the mounting hole and engaging with the outer thread on one of the bottle and a tool mounted in the mounting hole and extending in the bottle.

8. The multifunctional cosmetic container as claimed in claim 6, wherein:

two of the bodies are bottles and each bottle has an opening and an outer thread formed on the body around the opening and the last body is a lipstick tube having a knob mounted rotatably on the lipstick tube and adapted to rotate to protrude or retract a lipstick and an outer sleeve mounted around the lipstick tube and adapted to cover the lipstick; and each of two of the caps has an inner thread formed in the mounting hole and engaging with the outer thread one of the bottles and a tool mounted in the mounting hole and extending in the bottle and the last cap has the mounting hole holding the lipstick tube.

* * * * *